US007659466B1

(12) United States Patent
Jang

(10) Patent No.: US 7,659,466 B1
(45) Date of Patent: Feb. 9, 2010

(54) TUNING DEVICE FOR STRINGED MUSICAL INSTRUMENT

(76) Inventor: Jin Tae Jang, 366-55 Dungchon-Dong, Kangsuh-Gu, Seoul (KR)

( * ) Notice: Subject to any disclaimer, the term of this patent is extended or adjusted under 35 U.S.C. 154(b) by 0 days.

(21) Appl. No.: 12/404,794

(22) Filed: Mar. 16, 2009

(51) Int. Cl.
*G10D 3/14* (2006.01)

(52) U.S. Cl. ..... 84/304

(58) Field of Classification Search ..... 84/173, 84/312 R, 304, 290
See application file for complete search history.

(56) References Cited

U.S. PATENT DOCUMENTS

| | | | | |
|---|---|---|---|---|
| 4,278,002 | A | 7/1981 | Siminoff | |
| 4,889,029 | A | 12/1989 | St. Denis | |
| 5,272,953 | A | 12/1993 | Koch | |
| 5,505,116 | A | 4/1996 | Pantoja | |
| 5,696,341 | A * | 12/1997 | McCane | 84/453 |
| 6,255,575 | B1 | 7/2001 | Pearse | |
| 2003/0094081 | A1 | 5/2003 | Becker et al. | |
| 2004/0040432 | A1 * | 3/2004 | Erickson et al. | 84/306 |
| 2005/0126014 | A1 | 6/2005 | Yamin et al. | |

* cited by examiner

*Primary Examiner*—Kimberly R Lockett
(74) *Attorney, Agent, or Firm*—IPLA P.A.; James E. Bame

(57) ABSTRACT

A tuning device for a stringed musical instrument comprising a socket to receive a peg of the instrument, a shaft rotatably connected to the socket, a motor to induce rotation of the shaft, a first gear to reduce the shaft rotation and increase torque from the motor, the first gear being engaged to the motor, a second gear to exponentially reduce the reduced shaft rotation, the second gear being engaged between the shaft and the first gear, a cutter to trim a string of the instrument, and a housing to cover and protect the shaft, the motor, and the gears, where the cutter is attached to the housing opposing the socket.

20 Claims, 7 Drawing Sheets

TUNING DEVICE FOR STRINGED MUSICAL INSTRUMENT

BACKGROUND

The invention relates to an apparatus to adjust tension or pitch of a vibrating string on a musical instrument, and more particularly, to an improved tuning device for a stringed musical instrument.

A string tuning apparatus is well known in the prior art, among musicians and individuals playing guitars, cello and other string instruments. These devices have usually been manually manipulated where the proper orientation and manipulation of the device was essential in the rotation of the pegs to tension associated musical strings. The manual manipulation to tune such instruments has been always burdensome especially to most individuals. The relative proximity of the various pegs about a mutual instrument has further complicated the tuning situation. There have been several attempts to develop tuning apparatus.

U.S. Pat. No. 5,505,116 to Pantoja discloses a musical instrument accessory which includes a socket having a face with an elongated opening proportioned to engaged the string tensioning pegs of a stringed instrument A lever extends outward from the socket and an elongated handle is attached to the lever at a location thereon that is spaced apart from said socket. The handle extends in a direction that is substantially at right angles to the face of the socket. The handle has a first handle portion which is directly attached to the lever and a pivoting second handle portion which extends alongside the first portion at a first orientation of the second portion and which extends at an angle relative to the first portion at a second orientation of the second portion. The second portion of the handle is attached to the first handle portion by a pivot coupling. First and second cutting inserts are secured to the first and second handle portions respectively at corresponding locations thereon which locations are spaced away from the pivot coupling. The cutting inserts have sharp cutting edges located to be in sliding contact with each other as the second handle portion is pivoted toward the first orientation of the handle portion.

U.S. Pat. No. 5,272,953 to Koch discloses a musical instrument string winder including a knob socket having an integral gear on one end and a socket for engaging a string winder knob on another end, the knob socket having a predetermined number of teeth; a handle having an integral gear on one end and a substantially flat gripping portion on another end, and the handle integral gear having a predetermined number of teeth. To produce more than one turn of the musical instrument knob for each crank of the handle, the number of teeth in the handle integral gear should be at least more than half the number of teeth of the knob socket integral gear.

U.S. Pat. No. 4,889,029 to St. Denis discloses a device for use in tuning a stringed instrument having a plurality of tuning pegs each of which can be rotated to alter the tension of a string associated therewith to vary the frequency of the note produced by the string when plucked, the device comprising a manually graspable body, a head member extending outwardly from the body and shaped to releasably engage one of the tuning pegs of the instrument, the body being separate from the instrument and movable such that the head member can be engaged with each of the pegs independently as required, a motor mounted in the body and arranged to drivingly rotate the head member to rotate said one peg, said motor being arranged to be rotated in both a clockwise and counterclockwise direction to tension and loosen the string as required, sensor means arranged to detect the note produced by the string when plucked and to calculate the fundamental frequency of the note, means storing a plurality of predetermined required frequencies, each associated with a respective one of the strings of the instrument, comparator means arranged to compare the fundamental frequency of the note of the string with said plurality of predetermined required frequencies and to select from said predetermined required frequencies that one of the frequencies which is closest to said fundamental frequency and means for driving rotation of the motor in a direction to alter the fundamental frequency of the note of the string to said one of the frequencies.

U.S. Pat. No. 4,278,002 to Siminoff discloses a fast-wind tubing machine including a knob which is coupled to a winder shaft of a tuning machine of a stringed musical instrument, such as a guitar. Coupled to the knob is an extension means to effectively extend the radius of rotation of the knob. The extension means may include a crank, the crank being pivotally connected to the knob so as to be movable from a concealed storage position to an operative position whereby the crank projects out from the knob so as to create an extended lever arm. The resultant extended lever arm effectively comprises approximately double the moment arm of the frame alone.

U.S. Pat. No. 6,255,575 to Pearse discloses a device for manually turning a tuning button of a stringed musical instrument for changing the tension of a string. In its preferred embodiment, the device has an elongated head with an open receptacle positioned at one end and on one side of the head for receiving the tuning button. An elongated handle is pivotally attached for rotational movement of the head, thereby turning the tuning button received within the open receptacle. The handle is positioned on the side of the head opposite to the side having the open receptacle and extends lengthwise along an axis laterally offset from a first axis of the head. Means for pivotally connecting one end of the handle to the other end of the head are provided, there being a pivot axis extending transversely, and preferably substantially perpendicularly to the first axis of the head.

U.S. Patent Publication No. 20050126104 to Yamin et al. discloses a cutting device comprising a first cutting blade, the blade comprising a first blade inside surface; a first blade outside surface; a first handle end portion; a first blade portion, the first blade end portion extending away from the first handle end portion and terminating at a first blade tip, the first blade portion having a first blade cutting edge and an opposing first blade blunt edge; a second cutting blade, the blade comprising a second blade inside surface; a second blade outside surface; a second handle end portion; a second blade portion, the first blade end portion extending away from the second handle end portion and terminating at a second blade tip, the second blade portion having a second blade cutting edge and an opposing second blade blunt edge; an articulating insert means for pivotally connecting the first cutting blade and the second cutting blade at an intersection portion location whereby the first cutting blade and the second cutting blade are movable between an open position where the first cutting blade and the second cutting blade are oriented transversely to each other, and a closed position wherein the first cutting blade and the second cutting blade are oriented alongside each other, the intersection portion further comprising an integral locking screw means for securing the first cutting blade and the second cutting blade in the closed position; and an integral spring means for facilitating moving the first cutting blade and the second cutting blade into the open position.

U.S. Patent Publication No. 20030094081 to Becker et al. discloses an electronic torque wrench including a workpiece-engaging head carried by a housing which also carries torque measuring apparatus including a processor operating under stored program control. A user interface is coupled to the torque measuring apparatus and includes a data input device and annunciator apparatus. The processor program responds to the input device for selectively setting or changing a preset torque level at any time, and compares torque values measured by the torque measuring apparatus with the preset torque level for causing the annunciator apparatus to produce an indication when the measured torque value coincides with the preset torque level.

The prior art has been trying to meet a continuing demand on the market to address stability, usabilty and effectiveness. A still growing demand is to introduce an improved string tuning device for a musical instrument. The present invention is to substantially fulfill the needs.

SUMMARY OF THE INVENTION

The present invention is contrived to overcome the conventional disadvantages. An object of the invention is to provide a tuning device for a stringed musical instrument, which controls a shaft rotation with efficiency using a set of planetary gears.

Another object of the invention is to a tuning device for a stringed musical instrument realizing an optimal reduction ratio of a shaft rotation.

Still another object of the invention is to provide capability of a tuning control preventing the string from being damaged by excessive string-winding and over-tightening of the string being wound.

In order to achieve these and other objects, a tuning device for a stringed musical instrument comprises a socket to receive a peg of the instrument; a shaft rotatably connected to the socket; a motor to induce rotation of the shaft; a first gear to reduce the shaft rotation and increase torque from the motor, the first gear being engaged to the motor; a second gear to exponentially reduce the reduced shaft rotation, the second gear being engaged between the shaft and the first gear; a cutter to trim a string of the instrument; and a housing to cover and protect the shaft, the motor, and the gears, wherein the cutter is attached to the housing opposing the socket.

In an embodiment, a tuning device for a stringed musical instrument comprises: a socket to receive a peg of the instrument; a shaft rotatably connected to the socket; a motor to induce rotation of the shaft, the motor being battery powered; a first planetary gear to reduce the shaft rotation and increase torque from the motor, the first gear being engaged to the motor; a second planetary gear to exponentially reduce the reduced shaft rotation, the second gear being engaged between the shaft and the first gear; a cutter to trim a string of the instrument; an internal ring gear engaged to the first and second gears to stabilize the shaft rotation;

a tuning control to prevent damage to the string, wherein the tuning control comprises a control circuit to monitor a voltage drop of the battery, wherein the control circuit breaks when the voltage drop reaches a preset threshold to prevent the string from being further wound in the socket; and a housing to cover and protect the shaft, the motor, the gears and the tuning control, wherein the cutter is attached to the housing opposing the socket.

For a better performance, the motor may be provided with a DC (direct current) motor to generate revolutions ranging 7,000 to 13,500 rpm, wherein the shaft rotation is reduced down between 110 and 210 rpm by the first planetary gear. The first planetary gear reduces initial revolutions from the motor down to one eighth (1/8). The second planetary gear reduces the reduced revolutions down to one sixty-fourth (1/64). The device may further comprise a pin puller to pull out a bridge pin of the instrument. The preset threshold is determined by an increase of current in the circuit.

Although the present invention is briefly summarized, the full understanding of the invention can be obtained by the following drawings, detailed description, and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

With reference to the accompanying drawings, a string tuning device will now be explained. FIGS. 1-4 each show a mechanism of the string tuning device, and FIGS. 5-8 each show application of the string tuning device to a stringed musical instrument which may be a guitar, cello and other string applied instruments.

Figure 1:
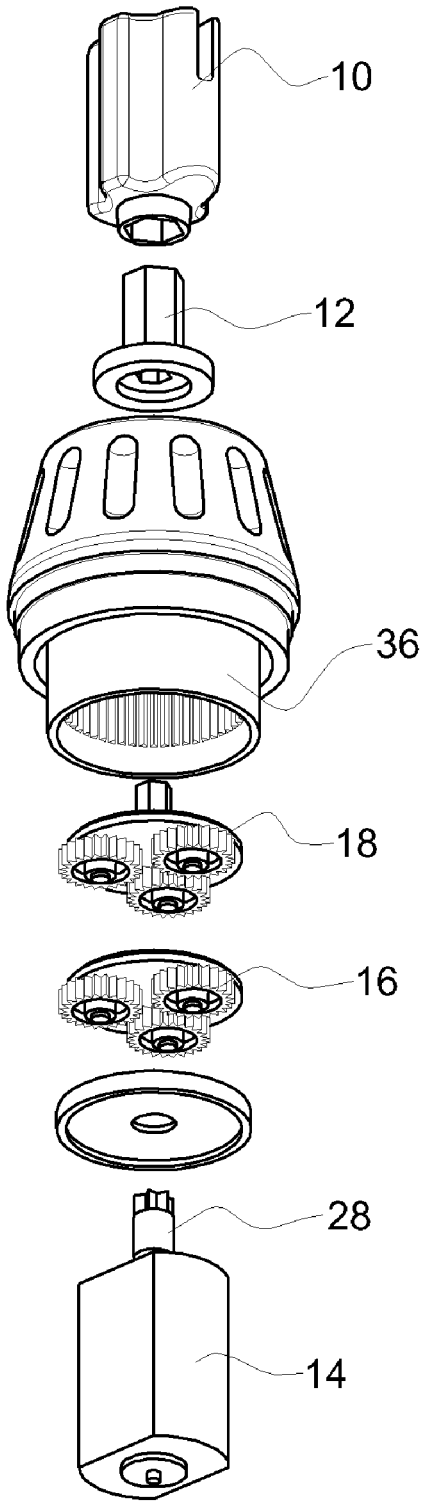
FIG. 1 is an exploded view showing a power transfer mechanism of the tuning device according to the present invention
Figure 2A:
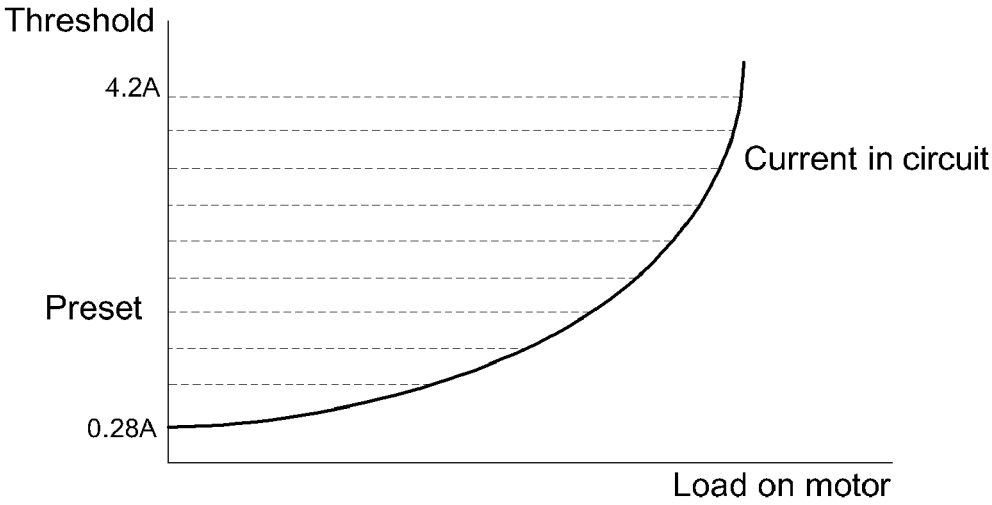
FIG. 2 is a block diagram showing mechanism of the tuning device according to the present invention.
Figure 2B:
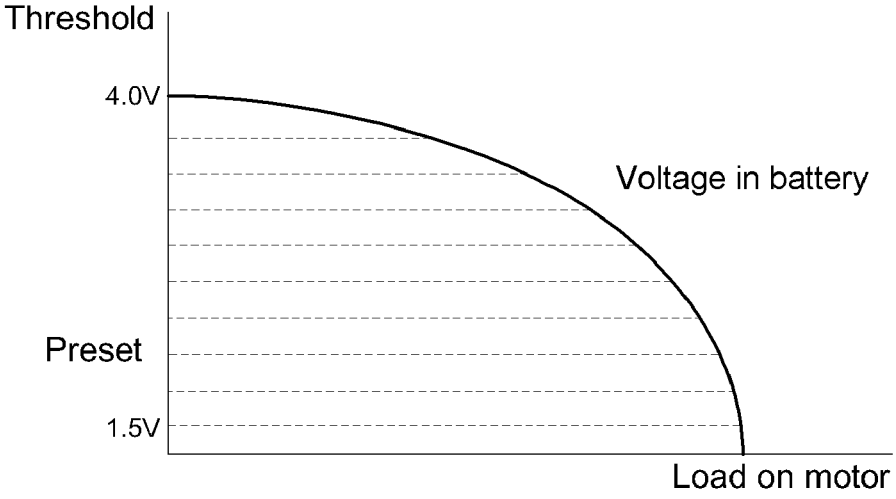
Figure 3:
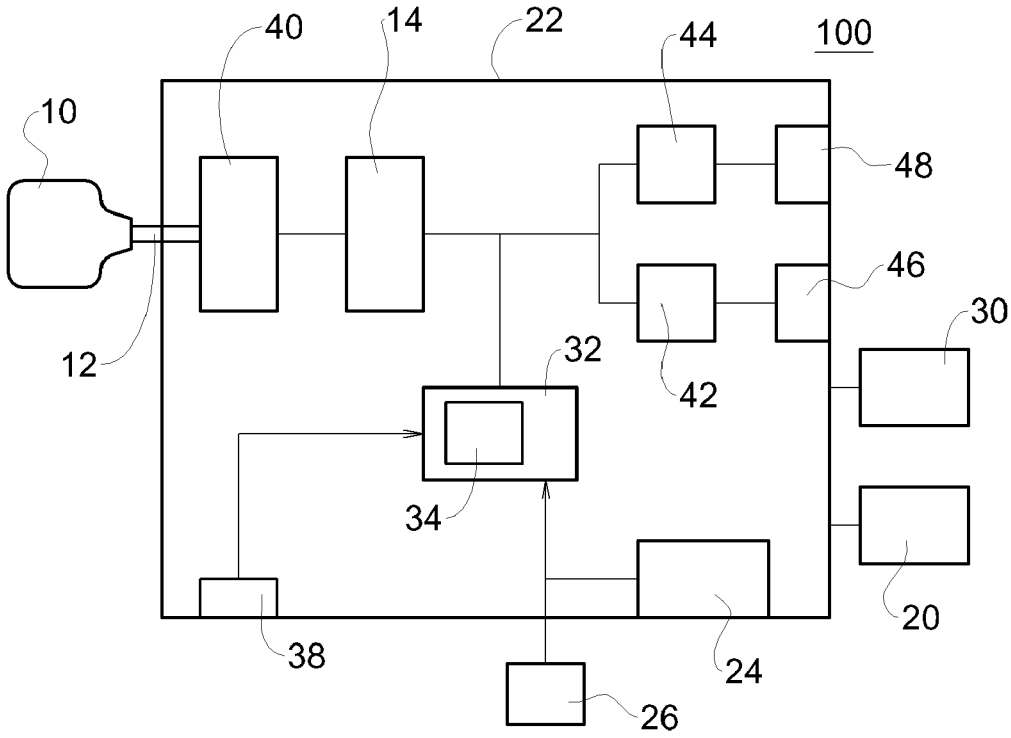
FIG. 3 is a block diagram showing a gear train according to the present invention.
Figure 4:
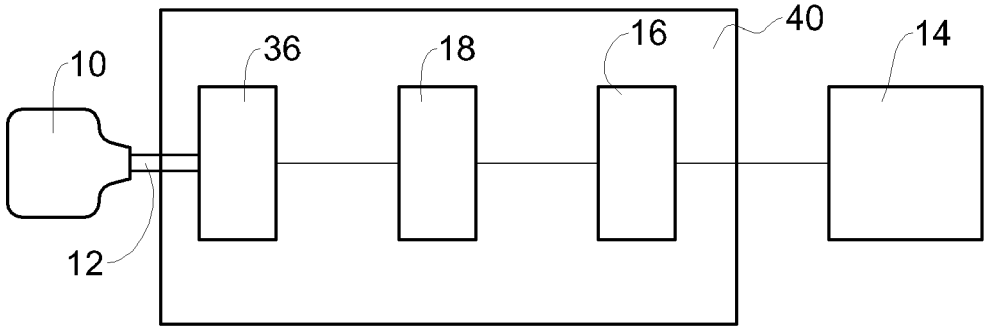
FIG. 4 is a schematic block diagram showing mechanism of the present invention.
Figure 5:
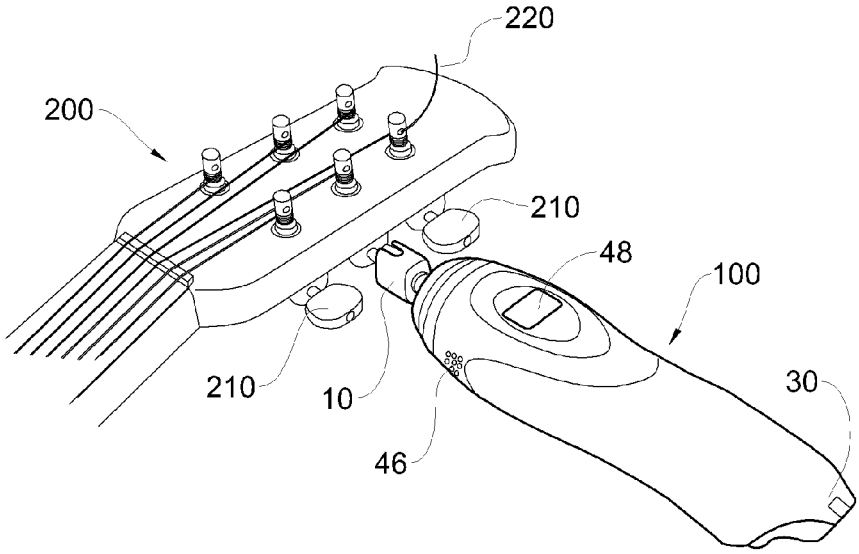
FIG. 5 is a schematic view showing application of the tuning device to a stringed instrument to tune the strings.
Figure 6:
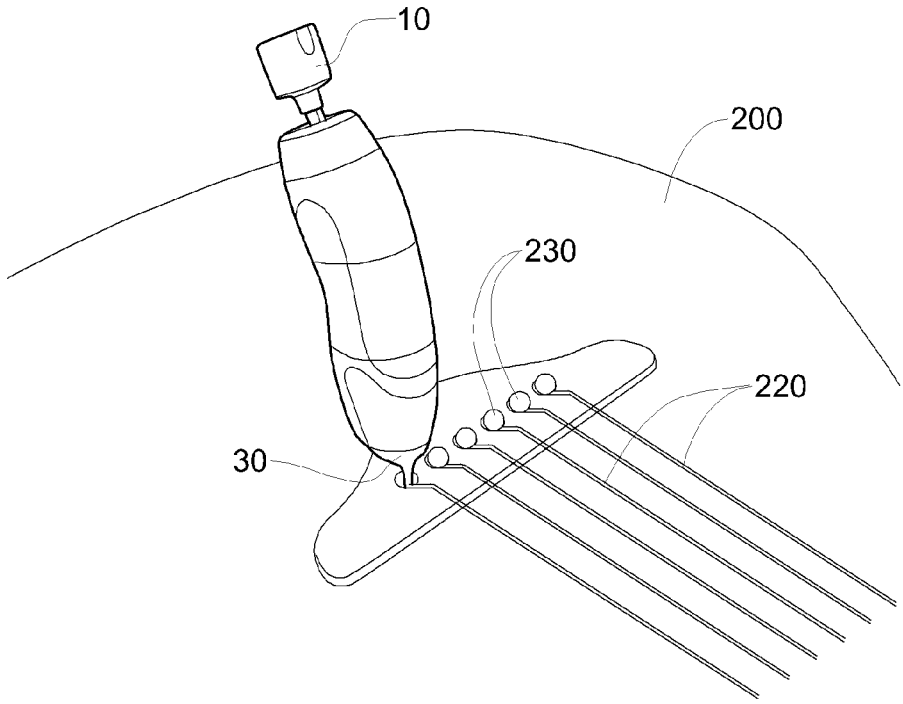
FIG. 6 is a schematic view showing application of the tuning device to a stringed instrument to pull out a bridge pin.
Figure 7:
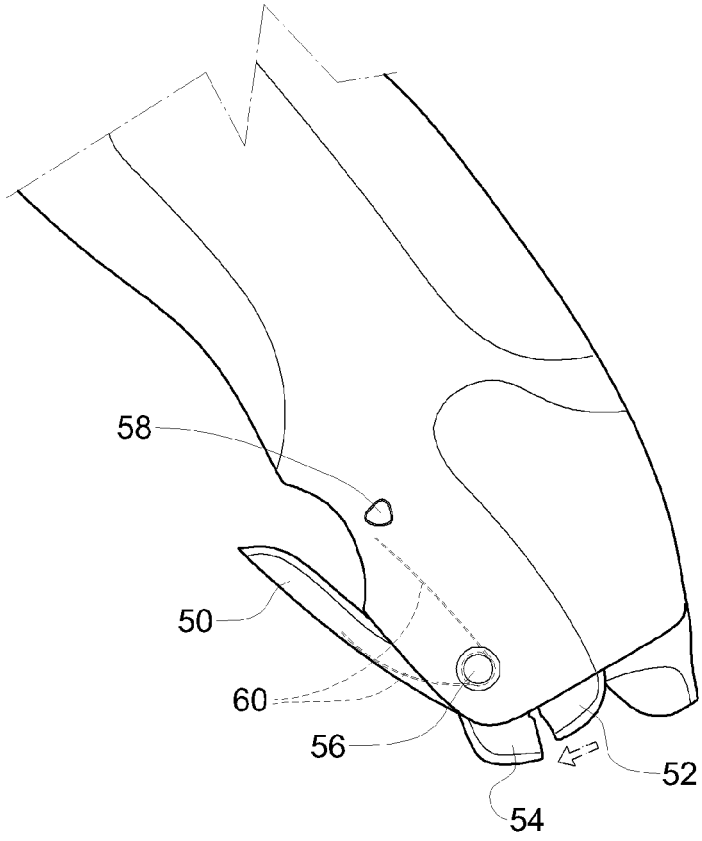
FIG. 7 is a schematic view showing a string cutter mechanism according to the present invention.
Figure 8:
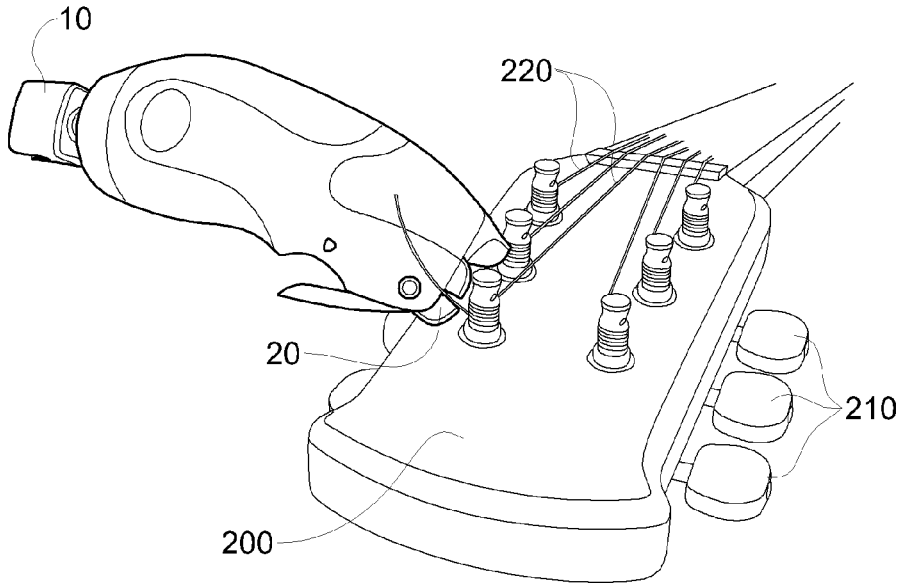
FIG. 8 is a schematic view showing application of the tuning device to a stringed instrument to cut an excessive length of a string.

As shown in FIGS. 1-3, a tuning device 100 for a stringed musical instrument 200 comprises a socket 10 to receive a peg 210 of the instrument 200. A shaft 12 is rotatably connected to the socket 10. A motor 14 is provided to induce rotation of the shaft 12. A first gear 16 is provided to reduce the shaft rotation and increase torque from the motor 14, where the first gear 16 is preferably engaged to the motor 14. A second gear 18 is provided to exponentially reduce the reduced shaft rotation, where the second gear 18 is preferably engaged between the shaft 12 and the first gear 16. The tuning device 100 comprises a cutter 20 to trim a string 220 of the instrument 200. In this construction, a housing 22 is provided to cover and protect the shaft 12, the motor 14, and the first and second gears 16,18. The cutter 20 is attached to the housing 22 opposing the socket 10.

Since the restringing device 100 is portable, it is recommended to employ a battery 24 or a DC adapter 26 ranging 2.4V to 7.5V. Such a DC motor generates a high speed of rotation ranging 7,000 to 13,500 rpm. An optimal rotation speed for restringing a stringed musical instrument ranges about 100 to 250 rpm. If the rotation speed falls below 100 rpm, then a user may witness a slowdown of the restringing speed thus to experience a low efficiency in tuning. To the contrary, if the rotation speed exceeds 250 rpm, the excessively fast speed may cause damage to the string 220 thus to lose product reliability. Therefore, it becomes crucial to decrease the shaft rotation to an optimal speed of 100 to 250 rpm.

In order to realize the optimal speed for the shaft rotation, the initial speed from the motor 14 needs to be decreased to reach the optimal speed. At an initial stage, the first gear 16 substantially decreases the initial rotation speed from the motor 14 and then the second gear 18 may exponentially decrease the rotation speed from the first gear 16. In a preferred embodiment, the first gear 16 may reduce initial revolutions from the motor 14 down to one eighth (⅛), and the second gear 18 may reduce the reduced revolutions down to one sixty-fourth (1/64).

For a better performance, the first and second gears 16, 18 may be formed of planetary gears, and the tuning device 100 may further comprise an internal ring gear 36 engaged between the planetary gears 16, 18 to stabilize the shaft rotation. For example, the planetary gears 16,18 may be formed with 30 mm in diameter. Preferably, a sun gear 28 extending from the motor 14 is provided in a six threaded gear, the planetary gears 16, 18 is each provided in an eighteen threaded gear, and the internal ring gear 36 is provided in a 42-threaded gear in order to realize an optimal rotation speed applicable to the peg 210 of the instrument 200. So included within a gear train 40 are the first and second gears 16,18 and the internal ring gear 36.

Considering that a DC motor carries torque below 40 g-cm ($4.0\times10^{-4}$ Nm), a simple adaptation of a DC motor to the tuning device 100 does not even provide a minimum torque of 750 g-cm ($7.5\times10^{-3}$ Nm) required to control winding or restringing of the string 220. Provided to solve these limitations are the planetary gears 16,18 which optimally reduce the speed of the shaft rotation and at the same time increase the deficient initial torque from the motor 14 to more than the minimal torque of 750 g-cm ($7.5\times10^{-3}$ Nm). The tuning device 100 enables any motor with a minimum torque of 18 g-cm ($4.0\times10^{-4}$ Nm) encompassing most commercial DC motors to easily increase its resulting torque to more than 1,000 g-cm ($1.0\times10^{-2}$ Nm) which is more than sufficient to restringing or winding the string 220.

The tuning device 100 may further comprises a pin puller 30 to pull out a bridge pin 230 of the instrument 200. The socket 10 may be detachably attached to the shaft 12. Further provided in the tuning device 100 is a tuning control 32. The tuning control 32 serves to prevent damage to the string 220. In this construction, the housing 22 is provided to further cover and protect the tuning control 32, wherein the cutter is attached to the housing opposing the socket.

The tuning control 32 comprises a control circuit 34. The control circuit 34 monitors a voltage drop of the battery 24. In this mechanism, the control circuit 34 breaks when the voltage drop reaches a preset threshold so as to prevent the string 220 from being further wound in the socket 10. The preset threshold is preferably determined by an increase of current in the circuit 34. The break of the control circuit 34 further prevent excessive tension, over-restringing, over-tightening to the string 220.

In another embodiment, the shaft rotation is adjustable to either a fast winding mode or a fine tuning mode. The motor 14 is battery powered. Alternately, the motor 14 is a DC (direct current) motor to generate revolutions ranging 7,000 to 13,500 rpm so the shaft rotation is reduced down between 110 and 210 rpm by the gear train 40.

Alternatively, the tuning device 100 is provided with a built-in microphone 38 to redirect information of vibration frequency of the string 220 to the tuning control 32 to generation an optimal tuning value. The built-in microphone 38 is preferably employed to tune an acoustic guitar.

An audible and visual alert mechanism may apply to the tuning device 100. In specific, when the vibration frequency of the string 220 approaches a predetermined value, an audible alert unit 42 may alert the user through a built-in speaker 46 or a visual alter unit 44 may generate a visual alert through a built-in screen 48. The contents of the audible alert is gradually changed as the vibration frequency approaches to or recedes from the predetermined value. The contents may be tone, amplitude or frequency of the audible alert. In a similar manner, the visual alert unit 44 generates a visual alert when the vibration frequency of a string approaches to a predetermined value. The contents of the visual alert is gradually changed as the vibration frequency approaches to or recedes from the predetermined value. The contents may be light intensity or blinking frequency of a tuning guide light, or numbers or symbols displayed on the screen 48.

To facilitate cutting of an excessive length of the string 220, the string cutter 20 includes a cutter handle 50, a moving cutter blade 52, and a fixed cutter blade 54. The string cutter 20 is provided to remove an excess length of the string 220. The moving cutter blade 52 is pivoted toward the fixed cutter blade 54 by a pivot pin 56 in accordance with an inward movement of the cutter handle 50. A cutter release button 58 and a spring coil 60. The spring coil 60 presses the cutter handle 50 outward from the housing 22 and the cutter handle 50 in turn pivots the moving cutter blade 52 away from the fixed cutter blade 54. When the cutter release button 58 is pushed, the cutter handle 50 is pivoted outward from the housing 22 by the spring coil 60. The spring coil 60 also returns the cutter handle 50 when a user releases the cutter handle 58 after cutting the string 220.

While the invention has been shown and described with reference to different embodiments thereof, it will be appreciated by those skills in the art that variations in form, detail, compositions and operation may be made without departing from the spirit and scope of the invention as defined by the accompanying claims.

What is claimed is:

1. A tuning device for a stringed musical instrument, comprising:

a socket to receive a peg of the instrument;

a shaft rotatably connected to the socket;

a motor to induce rotation of the shaft;

a first gear to reduce the shaft rotation and increase torque from the motor, the first gear being engaged to the motor;

a second gear to exponentially reduce the reduced shaft rotation, the second gear being engaged between the shaft and the first gear;

a cutter to trim a string of the instrument; and a housing to cover and protect the shaft, the motor, and the gears, wherein the cutter is attached to the housing opposing the socket.

2. The device of claim 1, wherein the first gear reduces initial revolutions from the motor down to one eighth (⅛).

3. The device of claim 1, wherein the second gear reduces the reduced revolutions down to one sixty-fourth (1/64).

4. The device of claim 1, further comprising a pin puller to pull out a bridge pin of the instrument.

5. The device of claim 1, further comprising an internal ring gear engaged to the first and second gears to stabilize the shaft rotation.

6. The device of claim 1, wherein the first and second gears are planetary gears.

7. The device of claim 1, wherein the socket is detachably attached to the shaft.

8. The device of claim 1, wherein the motor is a DC (direct current) motor to generate revolutions ranging 7,000 to 13,500 rpm.

9. A tuning device for a stringed musical instrument, comprising:

a socket to receive a peg of the instrument;

a shaft rotatably connected to the socket;

a motor to induce rotation of the shaft;

a first gear to reduce the shaft rotation and increase torque from the motor, the first gear being engaged to the motor;

a second gear to exponentially reduce the reduced shaft rotation, the second gear being engaged between the shaft and the first gear;

a cutter to trim a string of the instrument;

a tuning control to prevent damage to the string; and a housing to cover and protect the shaft, the motor, the gears and the tuning control, wherein the cutter is attached to the housing opposing the socket.

10. The device of claim 9, wherein the tuning control comprises a control circuit to monitor a voltage drop of the motor, wherein the control circuit breaks when the voltage drop reaches a preset threshold to prevent the string from being further wound in the socket.

11. The device of claim 9, wherein the shaft rotation is adjustable to either a fast winding mode or a fine tuning mode.

12. The device of claim 9, wherein the first gear reduces initial revolutions from the motor down to one eighth (1/8), wherein the second gear reduces the reduced revolutions down to one sixty-fourth (1/64).

13. The device of claim 9, further comprising a pin puller to pull out a bridge pin of the instrument.

14. The device of claim 9, further comprising an internal ring gear engaged to the first and second gears to stabilize the shaft rotation.

15. The device of claim 9, wherein the first and second gears are planetary gears.

16. A tuning device for a stringed musical instrument, comprising:

a socket to receive a peg of the instrument;

a shaft rotatably connected to the socket;

a motor to induce rotation of the shaft, the motor being battery powered;

a first planetary gear to reduce the shaft rotation and increase torque from the motor, the first gear being engaged to the motor;

a second planetary gear to exponentially reduce the reduced shaft rotation, the second gear being engaged between the shaft and the first gear;

a cutter to trim a string of the instrument;

an internal ring gear engaged to the first and second gears to stabilize the shaft rotation;

a tuning control to prevent damage to the string, wherein the tuning control comprises a control circuit to monitor a voltage drop of the battery, wherein the control circuit breaks when the voltage drop reaches a preset threshold to prevent the string from being further wound in the socket; and a housing to cover and protect the shaft, the motor, the gears and the tuning control, wherein the cutter is attached to the housing opposing the socket.

17. The tuning device of claim 16, wherein the motor is a DC (direct current) motor to generate revolutions ranging 7,000 to 13,500 rpm, wherein the shaft rotation is reduced down between 1110 and 210 rpm by the gear train.

18. The tuning device of claim 16, wherein the first planetary gear reduces initial revolutions from the motor down to one eighth (1/8), wherein the second planetary gear reduces the reduced revolutions down to one sixty-fourth (1/64).

19. The tuning device of claim 16, further comprising a pin puller to pull out a bridge pin of the instrument.

20. The tuning device of claim 16, wherein the preset threshold is determined by an increase of current in the circuit.

* * * * *